US006742668B1

(12) United States Patent
Perlman

(10) Patent No.: US 6,742,668 B1
(45) Date of Patent: Jun. 1, 2004

(54) TILTING LIQUID STORAGE CONTAINER FOR EITHER OBLIQUE OR VERTICAL ENTRY OF PIPETS

(76) Inventor: Daniel Perlman, 94 Oakland Ave., Arlington, MA (US) 02476

( * ) Notice: Subject to any disclaimer, the term of this patent is extended or adjusted under 35 U.S.C. 154(b) by 2 days.

(21) Appl. No.: 10/301,258

(22) Filed: Nov. 21, 2002

(51) Int. Cl.[7] ..... B65D 25/24
(52) U.S. Cl. ..... 220/631; 206/459.1; 206/459.5
(58) Field of Search ..... 220/631

(56) References Cited

U.S. PATENT DOCUMENTS

| | | | | | |
|---|---|---|---|---|---|
| 279,915 | A | * | 6/1883 | Clark | 431/324 |
| 1,073,997 | A | * | 9/1913 | London | 215/41 |
| 2,596,034 | A | * | 5/1952 | Lambert, Jr. | 422/92 |
| 3,885,698 | A | * | 5/1975 | Lebel et al. | 220/631 |
| 4,293,084 | A | * | 10/1981 | Lussier | 222/158 |
| 4,909,392 | A | * | 3/1990 | Williams et al. | 206/509 |
| 5,071,277 | A | * | 12/1991 | Braun | 401/126 |

OTHER PUBLICATIONS

Photograph of Waterman Ink Bottle previously submitted with Information Disclosure Statement dated Feb. 20, 2003.

* cited by examiner

*Primary Examiner*—Joseph Man-Fu Moy
(74) *Attorney, Agent, or Firm*—Weingarten, Schurgin, Gagnebin & Lebovici LLP

(57) ABSTRACT

A liquid storage container that includes a body, a neck, and a neck opening in which the center axis of the neck may be oriented at a substantially vertical angle. The container includes a bottom wall that supports the container in a first substantially horizontal position and a front wall that adjoins the bottom wall and slopes upward at an obtuse angle from this bottom wall. This obtuse angle allows complementary angular rotation, i.e., tilting, of the front wall of the container beyond the obtuse angle, to a second substantially horizontal position in which the front wall supports the container. This rotation results in the center axis of the neck tilting from a substantially vertical angle to an oblique angle to provide variable angles of access to liquids stored therein using liquid transfer devices.

22 Claims, 2 Drawing Sheets

TILTING LIQUID STORAGE CONTAINER FOR EITHER OBLIQUE OR VERTICAL ENTRY OF PIPETS

CROSS REFERENCE TO RELATED APPLICATIONS

N/A

STATEMENT REGARDING FEDERALLY SPONSORED RESEARCH OR DEVELOPMENT

N/A

BACKGROUND OF THE INVENTION

This invention relates to laboratory liquid storage containers for use with pipets and other liquid transfer devices.

Specialized laboratory flasks whose bodies and neck geometries, and inner surfaces and wall materials have been adapted for the culturing of living cells have been described in the prior art.

Lyman in U.S. Pat. No. 4,770,854 describes a laboratory flask for cell culture that includes a wide-angled neck geometry for improved accessibility to the corners of the flask.

Lyman et al. in U.S. Pat. No. 4,927,764 describe a cell culture flask whose top wall includes a large opening to provide access to the surface upon which cells are grown. The opening is closed by a flexible transparent film sealed to the top wall, and peelable to provide access to the interior of the flask.

Serkes et al. in U.S. Pat. No. 5,151,366 describe a cell culture flask in which the media-immersed bottom surface includes corrugated regions to increase the available growth surface area, and also flat areas that allow visual and microscopic inspection of the growing cells.

Stevens et al. in U.S. Pat. No. 5,924,583 describe a cell culture flask that includes a neck, a portion of which is raised above the upper surface of the flask to maximize the height between the neck and the bottom wall of the flask. This geometry is intended to increase the usable volume of the flask.

In addition to cell culture flasks that have been modified in recent years, general purpose liquid storage containers used in laboratories have also undergone changes in recent years. These containers are now fabricated from a variety of thermoplastic resins and glasses that each have desirable physical properties and/or chemical resistances. Laboratory containers include narrow and wide-mouthed bottles and flasks with short or long necks (and jars without necks). These containers may be used for the storage of liquids used in the laboratory such as aqueous buffers, acids and alkalis, organic solvents, reagents, enzyme solutions, nutrient media and the like. Liquid storage containers are described in many different scientific catalogs [for examples see pages 149–191 in the current Fisher Scientific Catalog 2002–2003 Edition (Pittsburgh, Pa.)]. The geometries of storage bottles include cylindrical, square and rectangular-shaped bottles with narrow and wide mouth openings. Some bottles are designed with collapsible walls to save space when empty, or may include handles and hand grips. Most liquid storage containers have necks that extend vertically upward from the top of the containers. This location is considered practical since it maximizes the amount of liquid that can be held within a container.

On the other hand, cell culture flasks (described above) are typically incubated horizontally and have necks that extend essentially horizontally. With this orientation, the lower interior wall surface of the flask is covered by a thin layer of nutrient medium. Cell culture flasks are generally coated on their interior surface to promote cell adhesion, are costly, and are fabricated from polystyrene that has poor resistance to organic solvents. Thus, such flasks are not typically used for storing solvents and reagents in the laboratory.

Applicant is unaware of any general purpose laboratory container that has been designed so that its neck can be oriented either vertically or an oblique angle to provide variable angles of access to liquids stored therein using different liquid transfer devices.

BRIEF SUMMARY OF THE INVENTION

This invention relates to the configuration and laboratory use of a low profile liquid storage container that can be tilted between two alternate stable resting positions. The container in accordance with the invention employs a geometric shape, angles formed between adjacent walls, and the positioning of the neck and neck opening, which cooperate to allow the container to be tilted between two different resting positions that are useful for liquid transfer. For example, one resting position allows convenient oblique-angled entry of a micropipetter instrument's short disposable tip, while another position allows convenient vertical entry of a longer cylindrical pipet.

The container is compact and allows storage where space is limited. Preferably, milliliter volumetric graduation markings are provided on respective side walls. One set of markings is employed with the container in a first resting position, and the other set of markings is employed with the container in a second resting position.

BRIEF DESCRIPTION OF THE SEVERAL VIEWS OF THE DRAWING

The invention will be more fully described in the following detailed description in conjunction with the drawing in which.

DETAILED DESCRIPTION OF THE INVENTION

Figure 1:
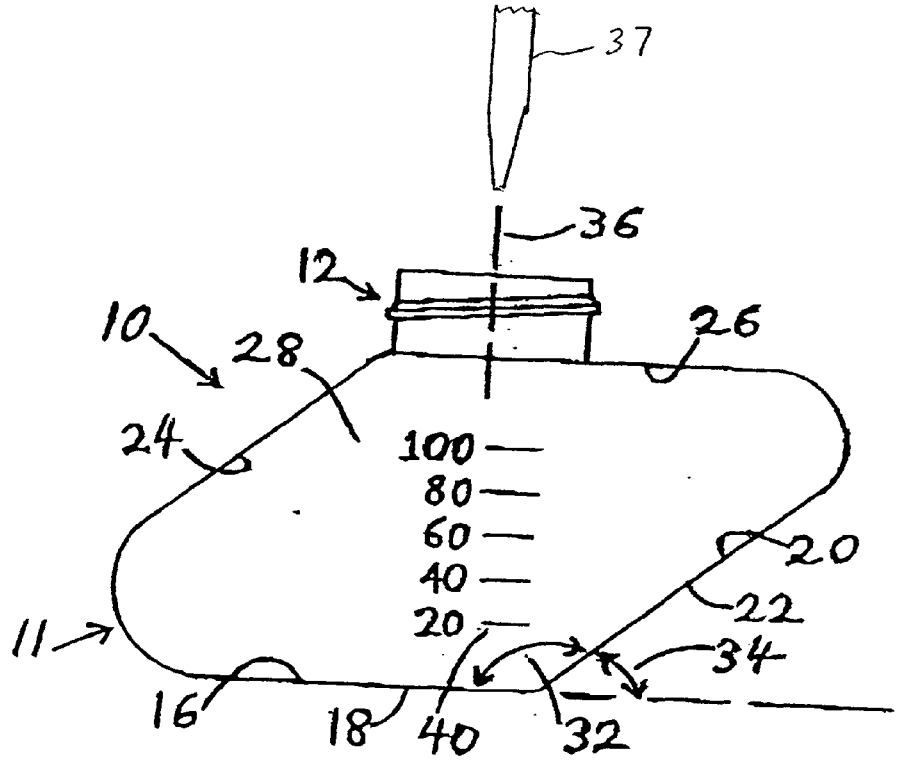
FIG. 1 is a side view of an open container of the present invention with the center axis of the neck oriented vertically.

Definitions.

As used in this description and the accompanying claims, the following terms shall have the meanings indicated, unless the context otherwise requires:

The term "liquid storage container" as used herein, is a bottle, flask or other reservoir or vessel capable of holding a liquid (e.g., either an organic solvent-based or a water-based liquid) without leaking. Preferably, the container is transparent or translucent for visualizing a liquid held within the container. Occasionally, for storage of photosensitive liquids, the container may be amber-colored or opaque. A variety of shapes and sizes may be considered in the design of the container, and a variety of different materials may be used for fabricating the container as described below.

The container consists of two principal portions, namely the body portion and the neck portion. The "body" constitutes the principal liquid-holding portion of the container, i.e., the reservoir, to which the neck portion is joined.

The terms "neck" and "neck opening" as used herein are their common definitions. That is, the neck is the narrowed part of a container running from the body of the container to the mouth, i.e., neck opening, of the container. The neck also extends upwardly about an axis (also termed the center axis) from the "upper wall surface" of the body of the container. The neck and neck opening elements of the container structure provide access to the inside of the container for adding or removing a liquid, solid or gaseous material. For practical reasons, the shape of the container's neck is usually cylindrical and short, and the neck opening is round to allow sealing of the neck opening using commercially available round screw-cap or snap-cap closures. If a screw cap closure is used, the neck is preferably fabricated, i.e., molded, with external screw threads having a standard pitch, and the neck size is preferably selected to accommodate a standard sized cap. For reasons of screw cap standardization, convenience of use and cost, the externally threaded neck is usually preferred over an internally threaded neck.

The "center axis" of the neck is the line traveling in and out of the container along the centerline of the neck. A liquid transfer device tends to approximately follow the center axis of the neck when entering and leaving a container.

The container has two alternate surfaces upon which it is designed to rest. These two surfaces (also referred to as "first and second support wall surfaces") are angularly disposed to each other and both located opposite, i.e., distal from, the neck opening of the container. These two surfaces are either essentially flat or include substantially planar outer wall surface portions that are adequate for supporting the container. The flat surfaces or substantially planar portions are located on the named "bottom" wall and the named "front" wall of the container. By definition, when the neck opening is oriented vertically upward, i.e., atop the container, the container is resting on its "outer bottom wall surface." Conversely, when the container is rotated, for example, through a 40 degree complementary acute angle (180 degrees minus an obtuse angle, e.g., 140 degrees, established between the bottom wall surface and the front wall surface of the container), it will rest horizontally on its former "outer front wall surface." For this second angular orientation, in the present example, the center axis of the neck is tilted downward to 50 degrees elevation (i.e., to a so-called "oblique angle" as defined herein) above the horizontal, while the front wall surface is elevated 40 degrees above the horizontal. These angles are more clearly illustrated in the Figures herein.

The term "substantially planar" as used herein, means that the wall surfaces upon which the container rests are sufficiently flat (or possess sufficient areas that lie in the same plane) so that the container is stable and exhibits little if any rocking when the container is placed on a flat surface.

The term "adjoining front wall" as used herein refers to a wall that again, is substantially planar and juxtaposed or nearly juxtaposed (for example, it could be separated by a rounded corner) to the outer bottom wall surface.

The term "parallelepiped" as used herein to describe the three-dimensional general shape of the container refers to a 6-faced polyhedron all of whose faces are parallelograms lying in pairs of parallel planes. A parallelogram is a quadrilateral with opposite sides parallel. There are many different forms of parallelepiped. These forms may vary from that of the simple cube to that of a six-sided rhomboid in which pairs of opposite faces consist of parallelograms whose angles are all oblique and whose adjacent sides are unequal. In the present invention, a preferred shape for the container is a parallelepiped having two pairs of rectangular faces (top-bottom and front-rear), and only one pair of rhombus-shaped faces (the two vertical side faces). These two side faces are preferably nearly equilateral rhombuses with rounded corners and angles of approximately 140°±10° and 40°±10°. In other words, when viewed from the top, bottom, front, and back, the container has a rectangular outer perimeter shape (ignoring the contribution of the neck). From the two sides, the container has a rhombus or rhomboid shape. A preferred set of rhombus angles are: obtuse angle of approximately 140°±5° and complementary acute angle of approximately 40°±5°. With the exception of the two faces of the container that are used as alternate horizontal resting surfaces to support the container, the other faces of the container need not have planar surfaces. For example, the container's outer and/or inner surface may be curved, convex or concave, smooth or rough, corrugated and the like.

As described herein, the "maximum volume" of liquid that can be stored in the present container is between 10 ml and 1 liter. This volume is not the total capacity of the container, but rather a lesser volume held within the body of the container that causes overflow at the neck opening when the neck of the container is oriented at an oblique angle. The above range of volumes is meant to span the range of common bottles and flask sizes found on laboratory shelves, including the common sizes of clinical centrifuge tubes (15 ml and 50 ml) currently used as "mini-storage bottles" in laboratories.

Referring to the Figures, liquid storage container 10 (approximate length 3.6 inches, width 2.0 inches, and height 2.25 inches) designed to hold between 100 and 125 milliliters of liquid, is typically blow-molded from virgin polypropylene, polyethylene or polyethylene terephthalate with container body 11 that holds liquids, threaded neck 12 and neck opening 14, that provide access to the inside of the container by means of a liquid transfer device such as a pipet or a pipetter instrument fitted with a disposable tip (approximately 1–4 inches long). Referring to FIG. 1, container 10 is formed with a bottom wall 16 that includes a substantially planar outer bottom wall surface 18, that supports the container, an adjoining front wall 20, that includes a substantially planar outer front wall surface 22, a rear wall 24, a top wall 26 from which neck 12 extends upward, and two vertical side walls 28 and 30. The outer front wall surface 22, slopes upward at an obtuse angle 32 from the bottom wall 16, and allows complementary acute vertical angular rotation 34 beyond the obtuse angle 32 to a new position that horizontally supports the container (see FIG. 2). This vertical angular rotation also tilts the center axis of the neck 12 from a vertical orientation 36 in FIG. 1 to an oblique upward angle 38 in FIG. 2.

Figure 2:
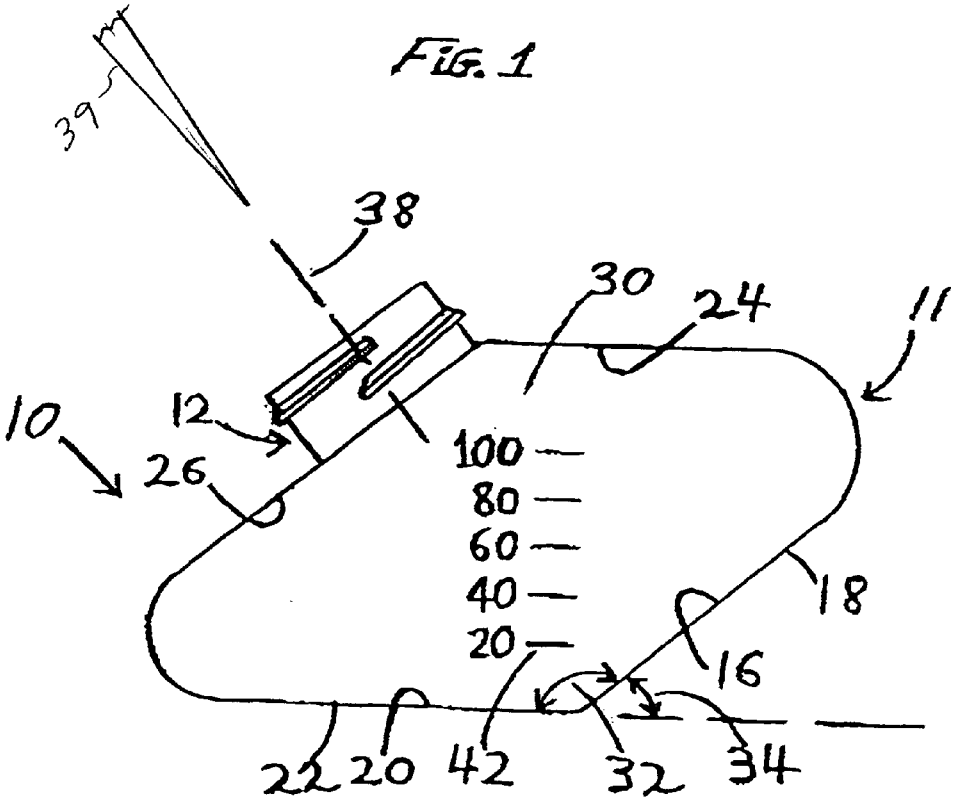
FIG. 2 is a view of the opposite side of the container shown in FIG. 1 after the container has been vertically rotated through an acute angle to a second, i.e., alternate, stable resting position.
Figure 3:
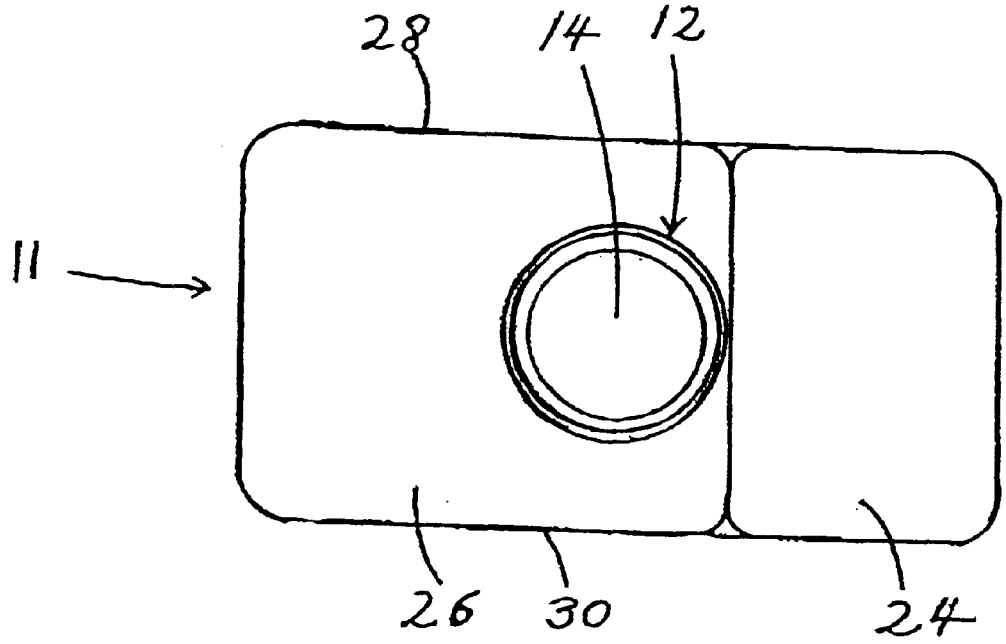
FIG. 3 is a top view of the open container shown in FIG. 1.
Figure 4:
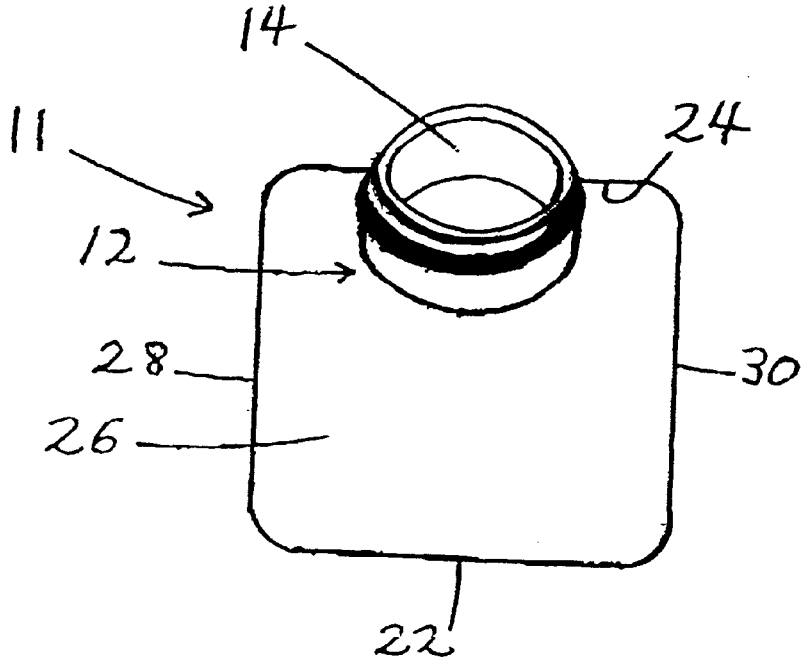
FIG. 4 is a front view of the open container shown in FIG. 2.

Preferably, milliliter volumetric graduation markings 40 and 42 (molded into the plastic or printed) are included on the side walls 28 and 30 respectively, to facilitate estimation of liquid volumes held within container 10. In FIG. 1, these graduation markings 40 are oriented perpendicular to the vertically oriented center axis 36 of the neck 12 so that any liquid meniscus will align parallel to these markings. In FIG. 2, the center axis of neck 12 has been tilted, i.e., rotated, approximately 40 degrees downward from its position in FIG. 1. Therefore, graduation markings 42 on side wall 30 must be set at an angle approximately 40 degrees upward from their orientation in FIG. 1 so that the liquid meniscus will align parallel to these graduation markings after the above-described tilting of the container has occurred.

The present invention concerns a laboratory storage container whose configuration and arrangement, i.e., size, shape, and location of neck opening, are selected to improve physical access, i.e., facilitate the transfer of liquids into and out of the container. This liquid transfer is generally effected by using either conventional cylindrical pipets or by using micropipetter instruments ("micropipetters") such as the Pipetman® micropipetter instruments manufactured by the Rainin Instrument Company (Woburn, Mass.). These and many other similar devices have become ubiquitous in laboratories. Micropipetters are generally fitted with a short disposable liquid dispensing tip whose length may vary between approximately one and three inches. A portion of a cylindrical pipet 37 is illustrated in FIG. 1 for use with the container in a first resting position with the neck opening disposed about a vertical axis. A portion of a pipetter tip 39 is: illustrated in FIG. 2 for use with the container in a second resting position with the neck opening tilted from the vertical axis. It is recognized that the container in either resting position can be used with a variety of pipets or pipetter instruments.

The configuration of the presently invented container with its obliquely angled neck opening is selected to minimize the distance between the neck opening and the bottom of the container. Minimizing this distance is important, for example, when using a micropipetter instrument fitted with a removably attached disposable sterile plastic dispensing tip (know as a "disposable tip" or "tip"). Such tips range in length from approximately 1.25 to 3 or 4 inches. It is preferable that a liquid stored in a container be accessible and removable when only the tip portion of the micropipetter has entered the container. If the upper portion of the micropipetter located above and proximal to the tip, and known as the pipetter barrel (that is neither clean nor sterile) is allowed to enter the container, contamination of the container and its contents is very possible.

To facilitate transfer and mixing of relatively small volumes of liquid (microliter and milliliter quantities) into and out of a container, the low profile container of the invention provides more convenient access to a liquid held therein. One design parameter important for providing this convenience is controlling, i.e., minimizing, the distance between the neck opening of the container and the inner bottom wall surface of the container where a quantity of liquid may be located. If a sufficiently short distance is maintained in this design parameter, then direct access to a liquid in the bottom of the container will be feasible using the disposable tip (typically 1–3 inches long) of the pipetter.

A second design parameter involves controlling the access angle to the liquid in the container. Besides pouring liquid in and out of a laboratory bottle, the most common means of transferring milliliter and microliter quantities of liquids involve the use of pipets and pipetter instruments or micropipetter instruments (collectively termed "pipetters" or "pipetter instruments"). Traditional glass and plastic pipets are conveniently held and operated vertically, and the liquid volumes held therein are read and adjusted while the pipet is held vertically. Therefore, a bottle having a vertically configured and arranged neck with a horizontally configured neck opening is generally convenient for use and manipulation of traditional pipets including serological, volumetric, bacteriological, transfer, dropping, milk, large-tip, long-tip, dye-industry, Pasteur, Kahn, Kolmer, Mohr, and Ostwald-Folin pipets, for example. Descriptions and definitions of these pipets as well as various others are provided in many different scientific catalogs [for examples see pages 1047–1065 in the current Fisher Scientific Catalog 2002–2003 Edition (Pittsburgh, Pa.)]

On the other hand, pipetter instruments with their removably attached short disposable tips are different in shape and in method of use from conventional pipets. Descriptions of various commercially available pipetter instruments, and in particular, single-channel air displacement pipetters are provided in many different scientific catalogs [see pages 1083–1090, for example, in the current Fisher Scientific Catalog 2002–2003 Edition (Pittsburgh, Pa.)]. Pipetter instruments are manually pre-set to a desired liquid transfer volume, thereby obviating any need to view the meniscus location, i.e., liquid level, in the device during the transfer process. Accordingly, most laboratory workers using pipetters prefer to hold the instrument at an oblique angle while dispensing or withdrawing liquid from a test tube or other container. Besides preventing muscular fatigue, the oblique angle for holding the pipetter instrument during liquid transfer helps prevent the possibility that a contaminating material on the barrel of the pipetter could fall directly downward into the container, since the barrel is angled obliquely upward and to the side of the neck opening of the container while only the clean and/or sterile tip that holds liquid enters the container.

Unlike a traditional bottle with a neck opening that only extends vertically upward from the top of the container, the neck portion of the presently invented flask can also extend obliquely upward (laterally outward as well as upward) from one of the walls of the container. That is, upon rotation of the container, the neck portion rotates from the conventional vertical orientation to an oblique angle of between approximately 40–60 degrees above the horizontal. This neck angle facilitates manual use of pipetter instruments by improving comfort and reducing muscular fatigue. Furthermore, owing to the size and shape of the container, and the location of the neck opening, the distance between the neck opening and the bottom of the container is much less than if the neck were located on the top wall of a traditional bottle. This proximity allows the laboratory worker to only insert the clean disposable tip of a pipetter instrument into the container (rather than both the barrel and the clean tip of the pipetter) in order to retrieve a quantity of liquid resting on the inner bottom wall of the container. Additionally, the angled neck opening helps alleviate an inherent problem of vertical neck openings. Vertical neck openings can allow particulate contaminants on the barrel of a pipetter to fall into the container.

The container differs in geometry from conventional laboratory test tubes, centrifuge tubes, laboratory bottles and flasks used for storing small volumes of liquid, e.g., 1.0 ml–1 liter volumes. That is, the container is distinguished by having two faces upon which it may stand, and a width that may be comparable to its height (hence its "low profile" description). With the container's neck oriented vertically upward, the container is convenient for liquid transfer using a traditional long cylindrical pipet. On the other hand, pipetter instruments are fitted with different sized disposable plastic dispensing tips holding between approximately 50 ul and about 5 ml. A micropipetter is adjusted to withdraw a pre-selected volume of liquid into the dispensing tip. Aseptic retrieval of liquids stored in the container is facilitated using the tip of a micropipetter. The short distance between the container's opening and its bottom and front walls is important because it allows a sterile disposable micropipette tip that is removably fitted to a micropipetter instrument to be inserted fully downward to the bottom of the container without the non-sterile upper barrel portion of the micropipetter instrument entering (and possibly contacting) the sterile inner portion of container. Since conventional micropipetter tips range in length from approximately 2 inches to approximately 4 inches, the distance from the neck opening to the container bottom is preferably kept to under 2 inches and in no case greater than about 4 inches. This compares with conventional storage of small volumes of laboratory liquids in clinical centrifuge tubes (15 ml and 50 ml capacities) that range in length from 4.5 to 5 inches. Such cylindrical tubes are currently used throughout the world for storing between 2 and 50 ml of liquid. In fact, to reach a liquid stored in the bottom of such a clinical centrifuge tube using a micropipetter tip, it is necessary to carefully tilt the tube (bringing liquid upward along the wall of the tube) while simultaneously pipetting if one is to avoid lowering the unclean micropipetter barrel down into the tube.

Thus in a first aspect, the invention features a liquid storage container for use in the laboratory. The container includes a body, a neck and neck opening, in which the center axis of the neck can be oriented at a substantially vertical angle. The container also includes a bottom wall that supports the container in a first substantially horizontal position on a laboratory bench or other work surface, and a front wall that adjoins the bottom wall and slopes upward at an obtuse angle from this bottom wall. The obtuse angle of the front wall allows complementary angular rotation, i.e., tilting, of the front wall beyond this obtuse angle, to a second substantially horizontal position in which this front wall supports the container. This rotation has also tilted the center axis of the neck from the original substantially vertical angle to an oblique angle. The two alternate angular orientations of the neck facilitate liquid transfer into and out of the container using different means of liquid transfer (e.g., pipets versus pipetter instruments) as explained in the embodiments below.

In a second related aspect, the invention features a liquid storage container for use with liquid transfer laboratory devices. The container includes a body having at least two side walls, a first support wall surface and a second support wall surface angularly disposed in relation to the first support wall surface. The body has an upper wall surface opposite the first support wall surface. A neck extends upwardly about an axis from this upper wall surface and defines a neck opening. The body can be positioned in a first resting position with the first support wall surface in a substantially horizontal plane and the neck disposed about a substantially vertical axis. Alternatively, the body can be positioned in a second resting position with the second support wall surface in a substantially horizontal plane and the neck disposed about an axis tilted from a substantially vertical orientation.

In one embodiment, the bottom wall and the front wall of the container include substantially planar outer wall surface portions. A flat or planar wall surface upon which the container rests, allows the container to beneficially remain stationary and stable on a laboratory bench or other work surface without the liquid rocking or splashing during liquid transfer operations.

In another embodiment, the center axis of the neck of the container is oriented at essentially a vertical angle, allowing insertion of a liquid transfer device vertically downward through the neck opening into the container.

In still another embodiment, the center axis of the neck of the container is tilted to an oblique angle, allowing insertion of a liquid transfer device obliquely downward through the neck opening into the container. This tilting of the center axis lowers the elevation of one side of the neck opening, improving access to liquid in the container using short-lengthened pipetter tips that are removably attached to pipetter instruments.

In yet another embodiment, the general three-dimensional shape of the body of the container is essentially a parallelepiped. The edges and corners of the container may be beneficially rounded to facilitate manufacture and cleaning of the container as well as facilitate access to liquids in these portions of the container.

In a related embodiment, the general two-dimensional shape of the body of the container when viewed from above is essentially a rectangle, and when viewed from the side is essentially a rhombus or a rhomboid. As above, the edges and corners of the container may be beneficially rounded.

In another embodiment, the inner diameter of the neck opening of the container is between 0.50 and 5.0 centimeters. This range of neck opening dimensions allows entry of a wide range of liquid transfer devices.

In a related embodiment, the inner diameter of the neck opening is between 1.25 and 3 centimeters. A neck opening of approximately 2 centimeters allows entry of many different liquid transfer devices, ranging from small diameter transfer pipets to much larger diameter serological pipets, e.g., 25–50 ml capacity serological pipets.

In another embodiment, the neck opening of the container can be sealed by a closure selected from the group consisting of screw cap and snap cap closures. These closures are typically fabricated by injection molding of thermoplastic resins such as polypropylene, and are commercially available in many different diameters and styles.

In yet another embodiment, the maximum volume of liquid that can be stored in the presently invented container is between 10 ml and 1 liter. The maximum volume is defined as that volume accommodated without causing overflow of liquid when the container is oriented with its neck extending upward at an oblique angle (rather than the alternate vertical orientation).

In another embodiment, the obtuse angle between the outer bottom wall surface and outer front wall surface is between 120° and 150°. With a complementary acute angle of rotation [defined as 180° minus (120° to 150°)=(60° to 30°)] beyond this obtuse angle, a new or alternate horizontal resting position for the container is established.

In a related embodiment, a preferred obtuse angle is approximately 140°±5° and the complementary acute vertical angular rotation is approximately 40°±5°.

In another embodiment, the container is fabricated from a glass material or from a thermoplastic resin material.

In a related embodiment, the container is fabricated from a thermoplastic resin material selected from the group consisting of polypropylene, polyethylene, polyethylene terephthalate, polycarbonate, polystyrene, polyvinylchloride and tetrafluoroethylene.

In another related embodiment, the container is fabricated from a glass material selected from the group consisting of flint glass, soda-lime glass, amber glass and borosilicate glass.

In another embodiment, the liquid transfer device used with the container for adding or removing a liquid is selected from the group consisting of pipets and pipetter tips removably attached to pipetter instruments.

In a related embodiment, the pipets are selected from the group consisting of glass pipets and plastic pipets.

In another related embodiment, the glass pipets and plastic pipets are selected from the group consisting of serological, volumetric, bacteriological, transfer, dropping, milk, large-tip, long-tip, dye-industry, Pasteur, Kahn, Kolmer, Mohr, and Ostwald-Folin pipets.

All patents and publications mentioned in the specification are indicative of the levels of skill of those skilled in the art to which the invention pertains. All references cited in this disclosure are incorporated by reference to the same extent as if each reference had been incorporated by reference in its entirety individually.

One skilled in the art would readily appreciate that the present invention is well adapted to carry out the objects and obtain the ends and advantages mentioned, as well as those inherent therein. The specific methods and compositions described herein as presently representative of preferred embodiments are exemplary and are not intended as limitations on the scope of the invention. Changes therein and other uses will occur to those skilled in the art which are encompassed within the spirit of the invention are defined by the scope of the claims.

It will be readily apparent to one skilled in the art that varying substitutions and modifications may be made to the invention disclosed herein without departing from the scope and spirit of the invention. For example, those skilled in the art will recognize that the invention may suitably be practiced using any of a variety of sources of material, e.g., diverse plastics and glasses, to fabricate the container, and any one of a variety of body shapes, sizes and contours besides a flat-walled parallelepiped container holding 100 ml of liquid for the body of the container.

The invention illustratively described herein suitably may be practiced in the absence of any element or elements, limitation or limitations which is not specifically disclosed herein. Thus, for example, in each instance herein any of the terms "comprising," "consisting essentially of" and "consisting of" may be replaced with either of the other two terms. The terms and expressions which have been employed are used as terms of description and not of limitation, and there is not intention that in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments and optional features, modification and variation of the concepts herein disclosed may be resorted to by those skilled in the art, and that such modifications and variations are considered to be within the scope of this invention as defined by the appended claims.

In addition, where features or aspects of the invention are described in terms of Markush groups or other grouping of alternatives, those skilled in the art will recognize that the invention is also thereby described in terms of any individual member or subgroup of members of the Markush group or other group. For example, if there are alternatives A, B, and C, all of the following possibilities are included: A separately, B separately, C separately, A and B, A and C, B and C, and A and B and C. Thus, the embodiments expressly include any subset or subgroup of those alternatives, for example, any subset of the types of plastic or glass materials used to fabricate the container. While each such subset or subgroup could be listed separately, for the sake of brevity, such a listing is replaced by the present description.

While certain embodiments and examples have been used to describe the present invention, many variations are possible and are within the spirit and scope of the invention. Such variations will be apparent to those skilled in the art upon inspection of the specification and claims herein. Other embodiments are within the following claims.

What is claimed is:

1. A laboratory liquid storage container comprising:

a body having at least two side walls, a first support wall surface and a second support wall surface angularly disposed in relation to said first support wall surface;

said body having a first upper wall surface opposite said first support wall surface and a second upper wall surface opposite said second support wall surface, each side wall having a height between the first upper wall surface and the first support wall surface that is less than the maximum width of the sidewall measured perpendicular to its height;

a neck extending upwardly about an axis from said first upper wall surface and defining a neck opening, said neck opening being asymmetrically positioned in said first upper wall surface adjacent said second upper wall surface;

wherein said body can be positioned in a first resting position with said first support wall surface in a substantially horizontal plane and said neck disposed about a substantially vertical axis, and in a second resting position with said second support wall surface in a substantially horizontal plane and said neck disposed about an axis tilted from said substantially vertical axis; and wherein at least one of said side walls has volumetric graduation markings, respectively oriented for use with the container in at least one of said resting positions.

2. The container of claim 1 wherein said first and second support wall surfaces are substantially planar.

3. The container of claim 1 wherein said first and second support wall surfaces each have substantially planar portions.

4. The container of claim 1 wherein said second support wall surface is disposed in relation to said first support wall surface by a predetermined angle.

5. The container of claim 1 wherein each of two side walls have volumetric graduation markings, respectively oriented for use with the container in each resting position.

6. The container of claim 1 wherein said neck opening, when said container is in said first resting position, allows vertical insertion of a liquid transfer device downward through said neck opening into said container.

7. The container of claim 1 wherein said neck opening, when said container is in said second resting position, allows oblique insertion of a liquid transfer device downward through said neck opening into said container.

8. The container of claim 1 wherein the general three-dimensional shape of said body of said container is essentially a parallelepiped.

9. The container of claim 8 wherein the general two-dimensional shape of said body of said container when viewed from above is essentially a rectangle, and when viewed from the side is essentially a rhombus or a rhomboid.

10. The container of claim 1 wherein the inner diameter of said neck opening is between 0.50 and 5.0 centimeters.

11. The container of claim 10 wherein said inner diameter of said neck opening is between 1.25 and 3 centimeters.

12. The container of claim 1 wherein said neck opening is sealed by a closure selected from the group consisting of screw cap and snap cap closures.

13. The container of claim 1 wherein the maximum volume of liquid that can be stored in said container is between 10 ml and 1 liter.

14. The container of claim 1 wherein said container is fabricated from a glass material or from a thermoplastic resin material.

15. The container of claim 14 wherein said thermoplastic resin material is selected from the group consisting of polypropylene, polyethylene, polyethylene terephthalate, polycarbonate, polystyrene, polyvinylchloride and tetrafluoroethylene.

16. The container of claim 14 wherein said glass material is selected from the group consisting of flint glass, soda-lime glass, amber glass and borosilicate glass.

17. The container of claim 6 wherein said liquid transfer device is selected from the group consisting of pipets and pipetter tips removably attached to pipetter instruments.

18. The container of claim 17 wherein said pipets are selected from the group consisting of glass pipets and plastic pipets.

19. The container of claim 18 wherein said glass pipets and plastic pipets are selected from the group consisting of serological, volumetric, bacteriological, transfer, dropping, milk, large-tip, long-tip, dye-industry, Pasteur, Kahn, Kolmer, Mohr, and Ostwald-Folin pipets.

20. A laboratory liquid storage container comprising a body having opposing side walls, a neck, and a neck opening, wherein the center axis of said neck can be oriented at a first substantially vertical angle, and wherein said container also comprises a bottom wall that supports said container in a first substantially horizontal position, wherein said container further comprises a front wall that adjoins said bottom wall and slopes upward at an obtuse angle from said bottom wall, allowing complementary angular rotation of said front wall beyond said obtuse angle to a second substantially horizontal position wherein said front wall supports said container, wherein said rotation has tilted said center axis of said neck from said first substantially vertical angle to a second oblique angle, and wherein at least one of said side walls includes volumetric graduation markings along an axis normal to said bottom wall for use when said container is resting on said bottom wall and at least one of said side walls includes volumetric graduation markings along an axis normal to said front wall for use when said container is resting on said front wall.

21. The container of claim 20 wherein said obtuse angle is between 120° and 150° and said complementary acute vertical angular rotation is between 60° and 30°.

22. The container of claim 20 wherein said obtuse angle is approximately 140°±5° and said complementary acute vertical angular rotation is approximately 40°±5°.

* * * * *

UNITED STATES PATENT AND TRADEMARK OFFICE

CERTIFICATE OF CORRECTION

PATENT NO. : 6,742,668 B1
DATED : June 1, 2004
INVENTOR(S) : Daniel Perlman

It is certified that error appears in the above-identified patent and that said Letters Patent is hereby corrected as shown below:

Title page,
Insert Item -- [65], Prior Publication Data
US 2004-0099672-AL 27 May 2004 --;

Drawings,
Please delete the drawings, Figures 1-4 and insert the following new Figures 1-4:

*FIG. 1*

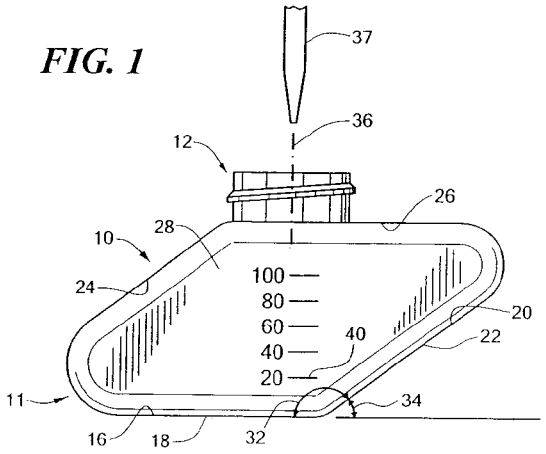

*FIG. 2*

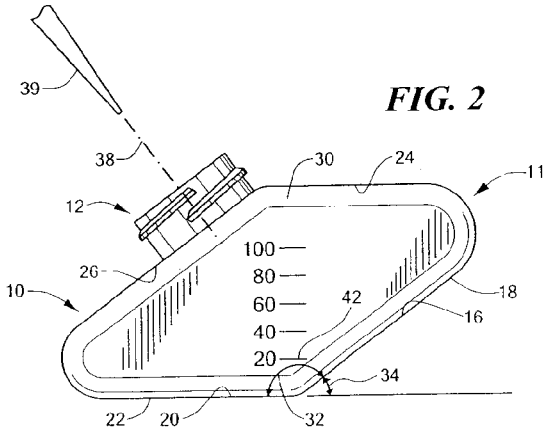

UNITED STATES PATENT AND TRADEMARK OFFICE

CERTIFICATE OF CORRECTION

PATENT NO. : 6,742,668 B1
DATED : June 1, 2004
INVENTOR(S) : Daniel Perlman

It is certified that error appears in the above-identified patent and that said Letters Patent is hereby corrected as shown below:

Drawings (cont'd),

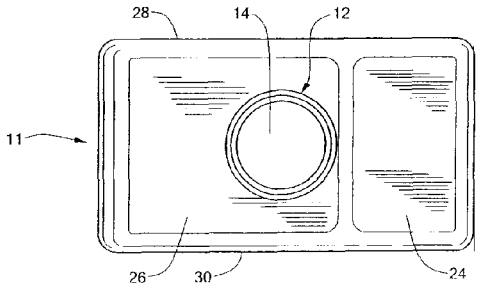

*FIG. 3*

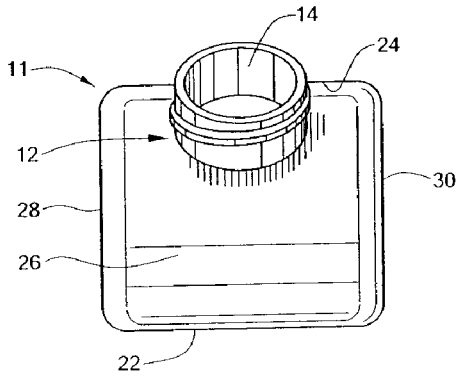

*FIG. 4*

Signed and Sealed this

Twenty-third Day of November, 2004

JON W. DUDAS
*Director of the United States Patent and Trademark Office*